United States Patent [19]

Kellermeyer

[11] Patent Number: 4,485,295

[45] Date of Patent: Nov. 27, 1984

[54] ELECTRICALLY HEATED FOR CUTTING FOAM PLASTIC MATERIAL

[75] Inventor: Christian Kellermeyer, Neuburg, Fed. Rep. of Germany

[73] Assignee: Tara GmbH, Fed. Rep. of Germany

[21] Appl. No.: 424,510

[22] Filed: Sep. 27, 1982

[30] Foreign Application Priority Data

Aug. 9, 1982 [DE] Fed. Rep. of Germany ... 8222457[U]

[51] Int. Cl.[3] ..... B26F 3/08; H05B 3/06

[52] U.S. Cl. ..... 219/221; 30/140; 83/16; 83/171; 156/251; 156/515; 156/583.1; 219/233; 219/243

[58] Field of Search ..... 219/221, 227, 230, 243, 219/233; 156/503, 515, 518, 583.1, 583.2, 251; 30/140; 83/15, 16, 170, 171

[56] References Cited

U.S. PATENT DOCUMENTS

| | | | |
|---|---|---|---|
| 1,584,371 | 5/1926 | Griffiths | 83/171 X |
| 1,992,250 | 2/1935 | Stacey | 83/171 X |
| 2,035,138 | 3/1936 | Maxfield | 219/221 |
| 2,182,656 | 12/1939 | Bruggimann | 83/171 X |
| 2,749,608 | 6/1956 | Siemer | 83/171 X |
| 2,916,595 | 12/1959 | Priestly | 83/171 |
| 3,117,211 | 1/1964 | Tansey | 219/221 X |
| 3,263,540 | 8/1966 | Lefevre et al. | 83/171 |
| 3,631,751 | 1/1972 | Stumpf | 83/171 |
| 3,693,253 | 9/1972 | Jager et al. | 83/171 |
| 3,876,858 | 4/1975 | Davis et al. | 219/243 |
| 3,978,749 | 9/1976 | Polenz | 83/171 X |
| 4,334,448 | 6/1982 | Messerschmitt | 83/171 |

FOREIGN PATENT DOCUMENTS

| | | | |
|---|---|---|---|
| 463083 | 2/1950 | Canada | 156/251 |
| 987227 | 4/1976 | Canada | 83/171 |
| 1270788 | 6/1968 | Fed. Rep. of Germany | 219/221 |
| 2052195 | 4/1972 | Fed. Rep. of Germany | 83/171 |
| 2520852 | 11/1976 | Fed. Rep. of Germany | 83/171 |
| 8713 | 2/1974 | Japan | 156/251 |
| 756447 | 9/1956 | United Kingdom | 83/16 |

*Primary Examiner*—A. Bartis

*Attorney, Agent, or Firm*—McCormick, Paulding & Huber

[57] ABSTRACT

An apparatus for cutting thermoplastic foam material, such as polyethylene foam or rigid polystyrene foam, includes an electrically heated cutting element made from a steel band and having a sharpened front longitudinal edge and a rear longitudinal edge spaced from one another by a width dimension of the band which is many times greater than the thickness thereof. The opposite end portions of the cutting element are parallel and close to one another and are each releasably gripped by a separate set of jaws which engage the front and rear edges of each end portion to mechanically support and supply electric current to the respective end portions. Each set of jaws includes a stationary jaw and a movable jaw. The movable jaws are connected for operation by a single operating member for movement in unison relative to the stationary jaws to facilitate rapid insertion and removal of the cutting element from the jaws. The jaws support the cutting element so as to project upwardly through a hole in the upper surface of a table supporting the material being cut and the jaws are arranged to permit the cutting element to be installed or removed from the jaws through the hole.

3 Claims, 7 Drawing Figures

ELECTRICALLY HEATED FOR CUTTING FOAM PLASTIC MATERIAL

The invention concerns an apparatus for cutting thermoplastic foam material such as polyethylene foam or rigid foamed polystyrene, including a cutting element connectible with a source of electric current and a holder for the cutting element.

It has been known for a long time to cut, for example, rigid foamed polystyrene with a wire heated by ohmic heat. A prime disadvantage of this known method is the low cutting speed at least in those cases in which the wire cannot be taughtly stretched, as is the case if the wire is bent to cut a definite profile in the foam material. In this case, if pressure is used on the bent wire or on the foam material workpiece the wire deflects or bends so that the desired shape of cut is not achieved.

On the other hand it is known to stamp, for example, polyethylene foam with cold work tools. This requires very high stamping pressure from which the accompanying disadvantage appears that the material is not only separated by the stamping tool but is also deformed.

Finally it is also known to cut foam material by cutting or sawing in which case dust-like waste is always formed.

The invention has as its object to provide an apparatus of the previously described kind which makes possible a high cutting speed with a wide variety of cut shapes and a high cutting accuracy without producing waste.

This object is solved in accordance with the invention by having the cutting element made from a steel band. This steel band forms a heated blade enabling a high cutting speed especially if its longitudinal edge which serves as the cutting edge is sharpened. For the manufacturing of this cutting element suitable band steel with a thickness of about one millimeter and a width of about twenty to thirty millimeters is obtainable in commerce in large rolls and can have one of its longitudinal edges presharpened. For making a cutting element a piece of this band steel may be cut off and bent to the desired profile, perhaps with the help of bending tools, whereby nearly any desired form can be manufactured.

To permit a rapid change of the cutting element, the holder can be made as a clamping device which includes jaws, each connectible to one pole of the current source, to chuck the cutting element. In order to achieve a straight, clean and reproducible cut without effort it is desirable that the apparatus have a workpiece supporting table with a table chassis and a table plate on which adjustable guide bars can be arranged to facilitate a guiding of the workpiece during the cutting process.

In a special embodiment of the invention suited to the cutting of profiles the holder for the steel band is arranged below the table plate, which in turn includes an opening for the steel band, and which steel band is bent to a profile and is chucked with its longitudinal ends in the holder. Above the table plate extends that portion of the steel band which, in the direction looking toward its cutting edge, has a cross-sectional shape corresponding to the profile to be cut. The foam material workpiece may then be pushed over the portion of the steel band extending above the table plate as by sliding it along a guide bar whereby a core of the desired profiled cross-section is cut out of the foam material workpiece. This allows very high cutting speeds to be achieved without degrading the quality of the cut profile.

For the production of simple straight cuts, for example for dividing larger foam material blocks into smaller portions, it is contemplated in accordance with the invention that the holder be made as a U-shaped frame which is arranged with its legs parallel to one of the table edges, and that the steel band be fastened at its longitudinal ends to the free ends of such U-frame legs and also connected at each end to one pole of the current source. Preferably the table plate is slidably supported relative to the cutting element so that the workpiece can be laid in a fixed position on the table plate and pushed together with the table plate to divide the workpiece. In this case a very high cutting speed is obtained without creating dust or crumblike waste.

The apparatus of the invention can also with good results be used to stamp forms from foam material blocks. In this case the holder is preferably arranged above the table plate and is movable vertically relative to it with the cutting element being arranged on the holder with its surfaces parallel to the direction of movement. The holder can in turn be guided for movement relative to a carrier on which a work cylinder is arranged for effecting such movement. For setting the stamping depth the table plate is guided for vertical adjustment relative to the machine frame and is so adjustable in heighth by means of two spindle motors. Preferably the table plate can be releasably fixed to the machine frame so as not to load the spindle motors during the stamping process. As has been shown, very clean cuts can be obtained with this stamping apparatus using only small pressures and without deforming or crushing the foamed material. It is further possible with the apparatus of the invention to stamp out forms which previously generally could not be produced practically in this way, by arranging, for example, on the holder which is movable vertically to the table plate a further holder, which is movable parallel to the table plate, for a further cutting element which is preferably positioned at an adjustable displacement from the table plate. This makes it possible to cut a definite closed shape to a given depth into a block of foam material and to then cut the stamped block with a horizontal separating cut, with the help of the further cutting element, so that a cut shape can be removed from the workpiece.

To enable the removal of the gases emitted during the cutting of thermoplastic foam material by means of the heated cutting element the cutting apparatus of the invention is preferably provided with a vacuum device for withdrawing such gases.

The temperature of the cutting element may be controlled in a simple way by having the current source formed by a transformer whose secondary winding, which supplies the cutting element, has a low number of turns relative to the primary winding, and by having the primary winding connected with a voltage regulator. By a decrease or an increase of the voltage to the primary winding the amount of current in the secondary winding and in the cutting element can be simply and exactly adjusted so that the desired temperature of the cutting element is reached.

The apparatus of the invention permits a high flexibility and a high cutting speed with low manufacturing and maintenance costs. With it one can now manufacture in an extremely simple way shapes in foam material which previously could be manufactured only with considerably expensive work tools and machines. This makes possible, especially in the packing industry as well as in the case of small product runs, the manufacture of packing units made of foam and suiting the shape of the product.

Further features and advantages of the invention will apparent from the following description which in connection with the accompanying drawings explains the invention by means of exemplary embodiments. The drawings are:

Figure 1:
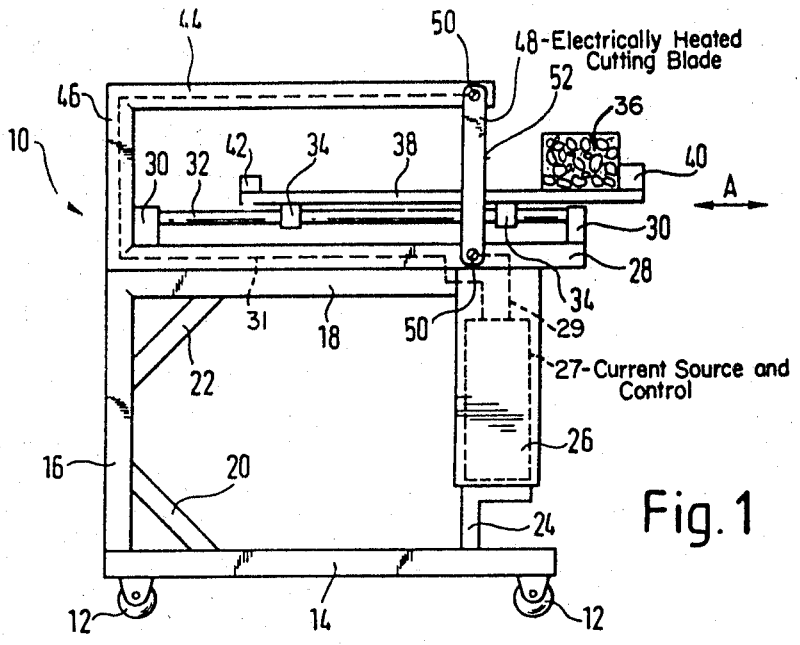
FIG. 1 is a partially schematic side view of a device embodying the invention for cutting foam material.

The cutting apparatus shown in FIG. 1 and indicated generally at 10 comprises a table understructure with a rectangular frame 14 supported by lockable rollers 12, rearward vertical posts 16 and an upper rectangular frame 18, with the vertical posts 16 being rigidly connected with the upper and lower rectangular frames 14 and 18 respectively with the aid of angle struts 20 and 22. At the front side of the table understructure the rectangular frame 14 has a case or cabinet 26 located on a supporting block 24 for receiving a current source and a control apparatus, shown by broken lines at 27, whose purpose will be described hereinafter.

On the upper rectangular frame 18 are two carriers 28 (of which only one is seen in the view of FIG. 1), which by means of support blocks 30 carry guide rods 32 extending parallel to the carriers 28. On the two guide rods (of which only one is to be seen in FIG. 1), a table plate 38 serving as a support for a workpiece 36 is supported with the help of sliding bearings 34 so as to be slidable back and forth in the direction of the arrow A. The table plate 38 carries a front and a rear locating bar 40 and 42, respectively, which can be used for situating the workpiece relative to the table plate. In this case the workpiece 36 is taken to be a block of thermoplastic foam material such as for example polyethylene foam or rigid polystyrene foam.

From the side of the cutting apparatus 10 viewed by the observer in FIG. 1, the carrier 28 forms one leg of a U-shaped frame having a further leg 44 and a connecting piece 46. Between the free ends of the two legs 44 and 28 a cutting element 48 made of a piece of band steel is fastened by means of screws 50. The screws 50 also serve at the same time as electrical terminals for connecting the cutting element 48 with cables 29 and 31 which are received in the hollow interior of the parts 28, 46 and 48 forming the U-shaped frame and which are connected in the cabinet to the two poles of the current source 27.

The cutting element 48 is so positioned that one of its longitudinal edges, which is sharpened and indicated at 52, is located at the right in FIG. 1, that is toward the front.

The cutting element 48 is heated to a temperature suitable for the plastic material in question by means of ohmic heat. After the cutting element 48 has reached the desired temperature the foam material workpiece located on the table plate is pressed at a desired place against the cutting edge 52 of the cutting element by pushing the table plate 38 to cause the cutting element 48 to cut into the foam material.

A very high cutting speed is obtained with the previously described cutting apparatus without creating dust or debris during the cutting. The cutting element 48 experiences practically no wear so that it may be made from an inexpensive simple band steel. With use of the innovative cutting apparatus the danger of severe injury, as is present both with rotating or circulating knives or saw blades, is practically excluded.

Figure 2:
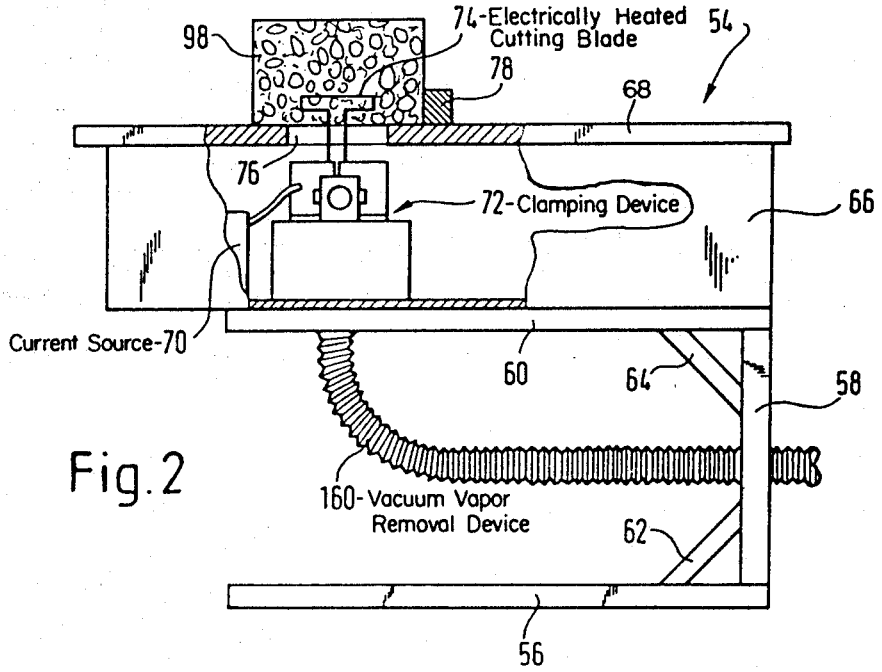
FIG. 2 is a partially broken away side view of a device embodying the invention for cutting profiles in foam material pieces.

While the cutting apparatus of FIG. 1 has a straight cutting element 48, whereby cuts similar to that produced by a band saw or a fret saw are produced, FIG. 2 shows an apparatus for cutting profiles or profiled grooves. The grooving and profiling machine indicated generally at 54 comprises a table undercarriage with a lower rectangular frame 56, vertical posts 58 and an upper rectangular frame 60 wherein the vertical posts 58 are connected with both of the rectangular frames 56 and 60, respecitvely, by means of angle struts 62 and 64 as in the embodiment of FIG. 1. On the upper rectangular frame 60 rests a table case 66 which is closed by means of a rigid table or workpiece support plate 68. The table case serves for receiving a current source 70 and a clamping device 72 for a profile cutting element 74, as well as for receiving a control device 71 (FIG. 3) for the current source 70. The current source 70, control device 71 and the clamping device 72 are explained in more detail hereinafter in connection with FIG. 3. A slot-like recess 76 is formed in the table plate 68 the width of which recess is at least equal to the width of the band steel used in making the profile cutting element 74. On the table plate 68 is a locating or guide bar 78 which is guided along the edges of the table plate for sliding movement relative to the table plate and which may be locked in any given position.

Figure 3:
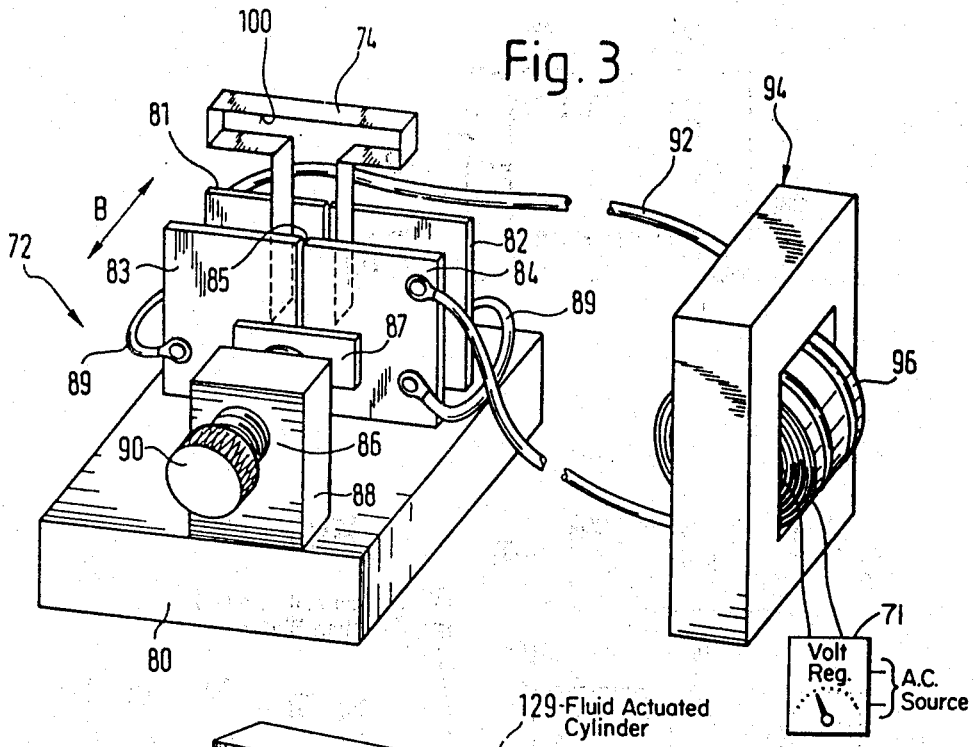
FIG. 3 shows in enlarged scale an arrangement for clamping the profiled cutting element for an apparatus according to FIG. 2.

In FIG. 3 the clamping device 72 and the current source 70 are shown in more detail. The clamping device 72, control device 71 includes a pair of fixed plate-like jaws 81 and 82 on a stationary base 80 as well as a pair of movable plate-shaped jaws 83 and 84 which are adjustable back and forth in the direction of the double arrow B by means of a threaded spindle 86. The jaws 81, 82, 83 and 84 are made of a conductive material and the clamps of each pair are separated and electrically isolated from one another through an air gap 85. The threaded spindle is journaled in a block 88 rigidly connected to the base 80, is provided with an operating knob 90 and engages an insulating piece 87 fixed to the two movable jaws.

Each stationary jaw 81 or 82 is electrically connected with its associated movable jaw 83 or 84 through a flexible conductor 89. The two jaws 81 and 84 are electrically connected to the two ends of the secondary winding 92 of a transformer 94 with the secondary winding 92 having a very low number of turns relative to the primary winding 96 of the transformer 94. The control device 71 is a voltage regulator connected between the primary winding and the A.C. source.

In the preceding case the cutting element 74 consists of a T-shaped bent piece of band steel one edge of which is again sharpened. Self-evidently the piece of bent band steel can be bent to any other desired profile. The cutting element 74 is gripped between the jaws 81, 82 and 83, 84 in such a manner that its longitudinal edges engage the surfaces of the jaws 81 and 83 on one side and of the jaws 82 and 84 on the other side. Therefore the cutting element, through which current flows in its longitudinal direction, cannot be bent or deflected if a foam material piece 98 (FIG. 2) laying on the table plate 68 against the bar 78 is pressed against the sharpened cutting edge 100 of the cutting element 74. Moreover, the innovative gripping device 72 permits a very rapid change of the cutting element if a different profile is desired. Through the gripping of the cutting element 74 there results at the same time a connection to the low voltage side of the transformer 94.

FIG. 2 shows that with the profiled cutting element profiled grooves as well as complete profiles can be cut. There is also to be added that naturally also in the case of the cutting apparatus of FIG. 1 not only flat cuts can be made but also profiled cuts can be created if the cutting element 48 is bent to a corresponding profile between its gripped ends.

To provide access to the holding apparatus 72 the table plate 68 is hingedly connected to the table case 66 for swinging movement relative thereto.

Figure 4:
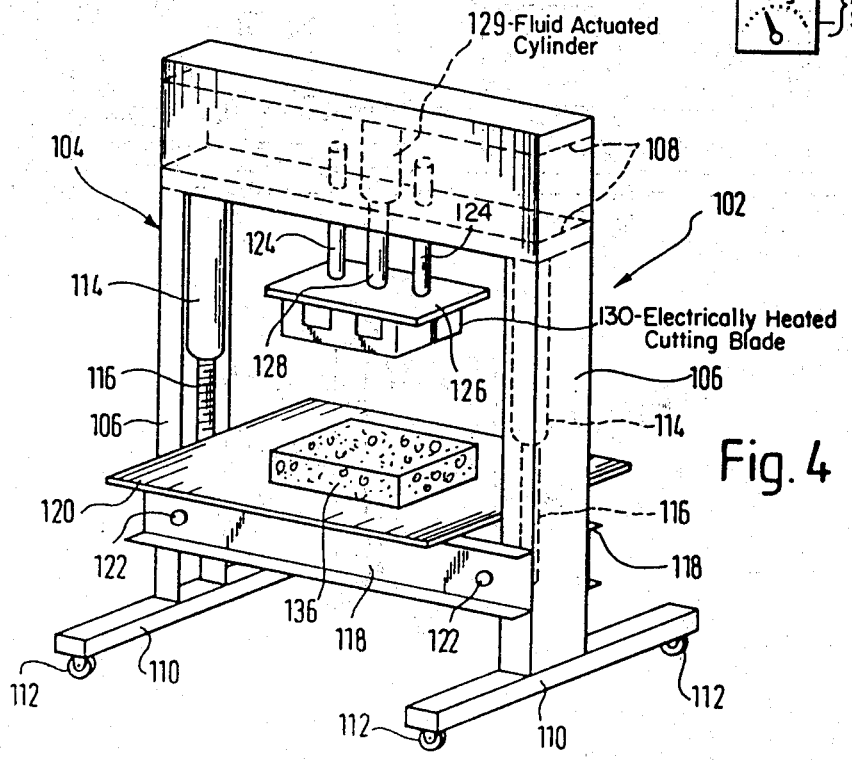
FIG. 4 is a partially schematic perspective view of a device for stamping foam material parts.

FIG. 4 shows an embodiment of the inventive cutting apparatus, indicated generally at 102, formed as a stamping machine. The stamping machine 102 includes a bridge-shaped frame 104 with vertical posts 106 which are connected at their upper ends to crossmembers 108 and which rest at their lower ends on beams 110 in turn supported on lockable rollers 112. The vertical posts 106 have U-shaped cross sections. In the general confines of these cross sections each of post has a spindle motor 114 fastened to it with the motor having a vertically arranged spindle 116 connected to two cross-carriers 118 which carry a plate 120 serving as a stamping table. By means of the spindle motors 114 the cross-carriers 118, and with them the stamping table 120, can be adjusted up and down. Adjacent each vertical post 106 the two cross-carriers 118 are connected to one another through a threaded bolt 122. By tightening the threaded bolts the cross-carriers 118 can be made to grip the vertical posts 106 so that the stamping table 120 is locked in its adjusted position, thereby unloading the spindle motors 114 during the stamping process.

Figure 5:
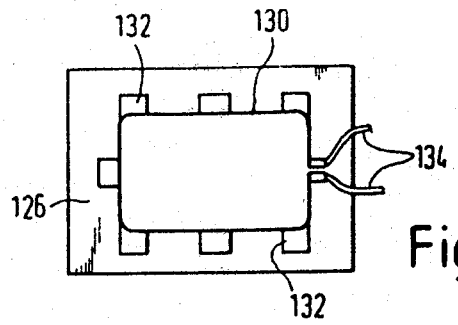
FIG. 5 is a plan view of the stamping tool.

To the lower one of the two crossmembers 108 a plateshaped tool carrier 126 is connected for vertically movement with the help of guide rods 124, the tool carrier being connected to the piston rod 128 of a pressure fluid activated cylinder 129 located between the two crossmembers 108. On the tool carrier 126 is fastened, with the help of angle pieces 132, a bent cutting element 130 made from a strip of band steel. The ends of the cutting element 130 are connected to a nonillustrated current source through associated conductors 134 (see FIG. 5), which current source is connected in the frame 104 with regulating and controlling devices.

After the cutting element is warmed to the desired temperature through the switching on of the current source, the tool carrier 126 and with it the cutting element 130 is moved with the help of the cylinder 129 toward the stamping table 120 and the cutting element stamps out the desired shape from the workpiece 136 lying on the stamping table 120. With uniform reciprocations of the work cylinder 129 the desired depth of stamping will be obtained through the previous adjustment of the height of the stamping table 120.

Figure 6:
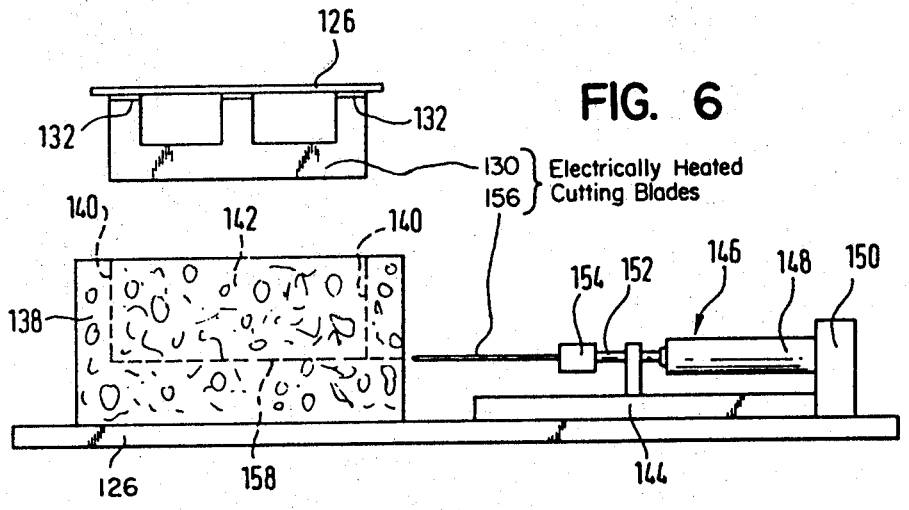
FIG. 6 is a partially schematic side view of two stamping work tools workable at right angles to one another and explains a method for stamping cavities in foam material blocks.
Figure 7:
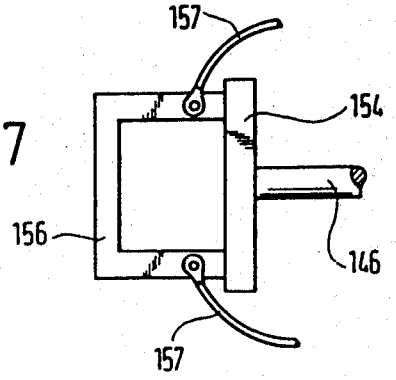
FIG. 7 is a plan view of the horizontally working stamping tool of the arrangement of FIG. 6.

With the innovative stamping machine only a very low stamping pressure is required and a very clean cut is obtained without the foam material becoming deformed or crushed. In contrast to all previously known stamping methods, with the innovative stamping machine it is also possible to stamp out of a foam material block a block shaped portion without having to stamp entirely through the original foam material block. This is explained in connection with FIG. 6. This shows only the stamping table 120 of the stamping machine shown in FIG. 4 as well as the stamping tool 130 on the tool carrier 126. The stamping tool 130 is pressed into the foam material block lying on the table plate 120 to the desired depth. As a result of this the vertical cut lines indicated at 140 and shown by broken lines are created. In order to remove the stamped core 142 from the foam material block 138 the stamped core 142 must be separated from the remaining portion of the foam material block 138 along its bottom surface. This was not possible with previous stamping methods. The innovative stamping device includes for this purpose a further stamping tool with a base plate 144 on which a piston cylinder arrangement 146 is supported, operated by example by air pressure, whose cylinder 148 is fixed to a block 150 connected to the base plate 140 and whose piston rod 152 carries at its forward end a tool holder 154 to which a cutting element 156 made of a strip of band steel is fastened (see also FIG. 7). This cutting element 156 is pushed horizontally sideways into the foam material block 138 by the piston cylinder arrangement 146 and thereby separates the stamped core 142 from the remaining portion of the foam material block 138 along the cut line 158 illustrated by broken lines. According to this process recesses of desired shape can be made in one side of the foam material block. Thus, in a very simple and cheap way packing can be manufactured for objects of complicated shape. Such packing could previously be manufactured only by injection molding of correspondingly shaped plastic parts through the use of very expensive molds.

It will be understood that the cutting element 156 is also connectible to a nonillustrated current source through connecting conductors 157, which current source may correspond to that shown in FIG. 3.

It is also to be added that all of the illustrated embodiments can be provided with a vacuum device, such as that represented in FIG. 2 by the duct 160, to remove the vapors released by the hot cutting of the thermoplastic material.

I claim:

1. An apparatus for cutting thermoplastic foam material such as polyethylene foam or rigid polystyrene foam, including a cutting element connectible to a current source and a holder for the same, characterized in that the cutting element is made from a steel band having generally parallel longitudinal edges spaced from one another by the width dimension of said band and which width dimension is many times greater than the thickness of said band, said cutting element having two end portions each releasably held by said holder and connected through said holder to said current source, said holder for each of said end portions of said cutting element having a set of two jaws each having a clamping face engageable with a respective one of said longitudinal edges of the associated end portion of said cutting element and arranged generally perpendicular to said width dimension of said cutting element, and means for manually moving said two jaws for each end portion toward and away from one another between one position at which the associated end portion is clamped between said clamping faces of said jaws with said clamping faces in engagement with said longitudinal edges and a position at which the associated end portion is free for movement into and out of said jaws, said two end portions of said cutting element being located near and generally parallel to one another, each of said sets of two jaws for each of said end portions including one stationary jaw and one movable jaw, a single manual operating member, and means interconnecting said single operating member to said movable jaws for moving both of said movable jaws in unison toward or away from their associated stationary jaws in response to operation of said single operating member.

2. An apparatus according to claim 1 characterized by a table having an upper horizontal surface for supporting material to be cut, said holder being located below said upper surface of said table, and said cutting element projecting upwardly at both of its end portions from said holder beyond said upper surface of said table.

3. An apparatus according to claim 2 characterized in that said cutting element projects upwardly from said holder through a hole in said table whereby a cutting element may be installed in or removed from said holder by being moved vertically through said hole, said jaw faces being in vertical planes.

* * * * *